US006824301B2

(12) United States Patent
Kinouchi

(10) Patent No.: US 6,824,301 B2
(45) Date of Patent: Nov. 30, 2004

(54) VEHICULAR HEADLAMP HAVING IMPROVED LOW-BEAM PATTERN

(75) Inventor: Toshiyuki Kinouchi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/383,595

(22) Filed: Mar. 10, 2003

(65) Prior Publication Data

US 2003/0174511 A1 Sep. 18, 2003

(30) Foreign Application Priority Data

Mar. 14, 2002 (JP) ..... P.2002-069577

(51) Int. Cl.[7] ..... F21V 7/00
(52) U.S. Cl. ..... 362/518; 362/297; 362/346
(58) Field of Search ..... 362/516–518, 362/296–297, 341, 346–350

(56) References Cited

U.S. PATENT DOCUMENTS 5,086,376 A * 2/1992 Blusseau ..... 362/518
5,171,082 A 12/1992 Watanabe
5,406,464 A 4/1995 Saito

* cited by examiner

*Primary Examiner*—Alan Cariaso
*Assistant Examiner*—Guiyoung Lee
(74) *Attorney, Agent, or Firm*—Sughrue Mion, PLLC

(57) ABSTRACT

A vehicular headlamp which provides a low-beam light distribution pattern having a horizontal cut-off line and an oblique cut-off line and which enhances distant visibility in the traveling line by assuring a sufficient amount of light in a hot zone, even if the height of a reflector is small. The reflecting surface of the reflector is configured to have first reflecting zones which reflect light so as to form a horizontal cut-off line, and second reflecting zones which reflect light so as to form an oblique cut-off line. The second reflecting zones Z2 are provided at two positions on right and left sides of the lamp optical axis Ax which are arranged diagonally with respect to the lamp optical axis Ax. The amount of light in a hot zone HZ is increased by superimposing light distribution patterns produced by the light reflected from each of the second reflecting zones. The cut-off line can be formed by providing the first reflecting zones at two positions on right and left sides which are closer to a periphery than the second reflecting zones.

10 Claims, 11 Drawing Sheets

VEHICULAR HEADLAMP HAVING IMPROVED LOW-BEAM PATTERN

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to a vehicular headlamp which produces a low-beam light distribution pattern having a horizontal cut-off line and an oblique cut-off line.

As a low-beam light distribution pattern for a vehicular headlamp, as shown in FIG. 10, a light distribution pattern P (L) having a horizontal cut-off line CL1 and an oblique cut-off line CL2 has been employed in many cases. In the low-beam light distribution pattern P (L), the horizontal cut-offline CL1 is arranged to fall on an opposite (oncoming) lane side and the oblique cut-off line CL2, which extends obliquely upward from the horizontal cut-off line CL1, is arranged to fall in the lane in which the vehicle is traveling so as to assure front visibility for the driver of the vehicle while preventing glare for the drivers of oncoming vehicles.

In order to obtain the desired low-beam light distribution pattern P (L), a conventional vehicular headlamp is configured such that a light source 2 is provided substantially coaxially with a lamp optical axis Ax extending in the longitudinal direction of the vehicle, and light from the light source 2 is directed to strike the reflecting surface 4*a* of a reflector 4 so as to form the cut-off lines CL1, CL2 from light which is reflected from reflecting zones 4*a*1, 4*a*2 that are on right and left sides, respectively, of the lamp optical axis Ax.

In the low-beam light distribution pattern P (L), a hot zone (area of high-intensity light) HZ is formed in an area in the vicinity of the left side of an elbow point E (an intersecting point of the cut-off line CL1 and the cut-off line CL2) thereof. The hot zone HZ is mainly formed by light reflected from an area close to the periphery of the reflecting zone 4*a*2.

A zone D shown by dashed lines in FIG. 10 is a zone where light does not strike the reflector due to the light blocking action of an inner shade 6 positioned directly below the light source 2. Also, a light distribution pattern Po (L) shown by a chain double-dashed line in FIG. 10 is a basic light distribution pattern which occurs if the reflecting surface 4*a* is constituted by a paraboloid of revolution whose central axis is the lamp optical axis Ax.

However, in the conventional vehicular headlamp, as shown in FIG. 11, if the height of the reflector 4 is reduced, the following problem arises.

The horizontal cut-off line CL1 is formed as a reverse image of a horizontal cut-off line L1 of the lower end edge of the reflecting zone 4*a*1, and the oblique cut-off line CL2 is formed as a reverse image of an oblique line L2 of the lower end edge of the reflecting zone 4*a*2. If the height of the reflector 4 is reduced beyond a certain amount, the oblique line L2 falls below the lower end edge of the reflecting surface 4*a*.

Accordingly, there arises a problem that the amount of light in the hot zone HZ becomes insufficient, and distant visibility in the traveling lane cannot be sufficiently assured.

BRIEF SUMMARY OF THE INVENTION

The present invention was made in consideration of these circumstances. It is an object of the present invention to provide a vehicular headlamp which produces a low-beam light distribution pattern having a horizontal cut-off line and an oblique cut-off-line, and which enhances the distant visibility in the traveling lane by assuring a sufficient amount of light in the hot zone even when the height of the reflector is small.

The present invention achieves this object by the design of the reflecting surface of the reflector.

More specifically, a vehicular headlamp according to the present invention includes a light source positioned coaxially with a lamp optical axis extending in the longitudinal direction of the vehicle on which the headlamp is mounted, and a reflector having a reflecting surface that reflects light from the light source forward and which provides a low-beam light distribution pattern having a horizontal cut-off line and an oblique cut-off line. In accordance with the invention, the reflecting surface has first reflecting zones which reflect light so as to form the horizontal cut-off line, and second reflecting zones which reflect light so as to form the oblique cut-off line. The second reflecting zones are provided at two positions on right and left sides of the lamp optical axis, arranged diagonally with respect to the lamp optical axis, and the first reflecting zones are provided at two positions on right and left sides which are closer to the periphery of the reflector than the second reflecting zones.

The light source, which is configured as part of a light source bulb, is not limited as long as the light source is mounted substantially coaxially with the lamp optical axis. For example, a filament such as that of a halogen bulb, a discharge light source of a discharge bulb, or the like can be employed. The light source bulb in some embodiments may include light blocking means, for example, an inner shade, a light blocking film or the like, for blocking part of the light directed from the light source to the reflecting surface of the reflector.

The second reflecting zones are not limited in size, outline, shape or the like as long as the second reflecting zones are provided at two positions on right and left sides of the lamp optical axis which are diagonally positioned with respect to the lamp optical axis.

The first reflecting zones are also not limited in size, outline, shape or the like as long as the first reflecting zones are provided at two positions on right and left sides which are closer to the periphery of the reflector than the second reflecting zones.

As described above, the vehicular headlamp according to the present invention provides a low-beam light distribution pattern having a horizontal cut-off line and an oblique cut-off line. The reflecting surface of the reflector has first reflecting zones which reflect light so as to form a horizontal cut-off line, and second reflecting zones which reflect light so as to form an oblique cut-off line. The second reflecting zones are provided at two positions on right and left sides of the lamp optical axis which are arranged diagonally with respect to the lamp optical axis, and the first reflecting zones are provided at two positions on right and left sides which are closer to the periphery of the reflector than the second reflecting zones. With this headlamp, the following actions and effects are obtained.

Since the second reflecting zones are provided at two positions on right and left sides of the lamp optical axis which are arranged diagonally with respect to the lamp optical axis, the amount of light in the hot zone is increased by superimposing the light distribution patterns which are formed by the light reflected from these two second reflecting zones at the two positions.

Therefore, even if the height of the reflector is small and the oblique line which is formed as a reverse image of the oblique cut-off line falls below the lower end edge of the reflecting surface, the amount of light in the hot zone is nevertheless sufficient.

Also, since the first reflecting zone is provided at two positions on right and left sides which are closer to the periphery of the headlamp than the second reflecting zones, even with the second reflecting zones provided at two positions on right and left sides of the lamp optical axis which are arranged diagonally with respect to the lamp optical axis, the desired horizontal cut-off line can be formed.

According to the inventive vehicular headlamp which provides a low-beam light distribution pattern having a horizontal cut-off line and an oblique cut-off line, even if the height of the reflector is small, distant visibility in the traveling lane is enhanced by assuring a sufficient amount of light in the hot zone in the low-beam light distribution pattern. Also, in a vehicular headlamp in which a reflector has a relatively large height, distant visibility in the traveling lane is further enhanced due to the increased amount of light in the hot zone.

In the above-described headlamp configuration, a light source bulb acting as the light source for the lamp may be configured such that part of the light directed from the light source to the reflecting surface of the reflector is blocked by an inner shade. For this purpose, a halogen bulb of the H4 type can be employed. However, if the light source bulb is configured to allow light from the light source to strike the entire zone of the reflecting surface, such as when a halogen bulb of the H7 type is employed, the low-beam light distribution pattern can be formed with a higher luminous intensity by effectively using the entire reflecting surface.

DETAILED DESCRIPTION OF THE INVENTION

Hereafter, preferred embodiments of the present invention will be explained with reference to the accompanying drawings.

Figure 1:
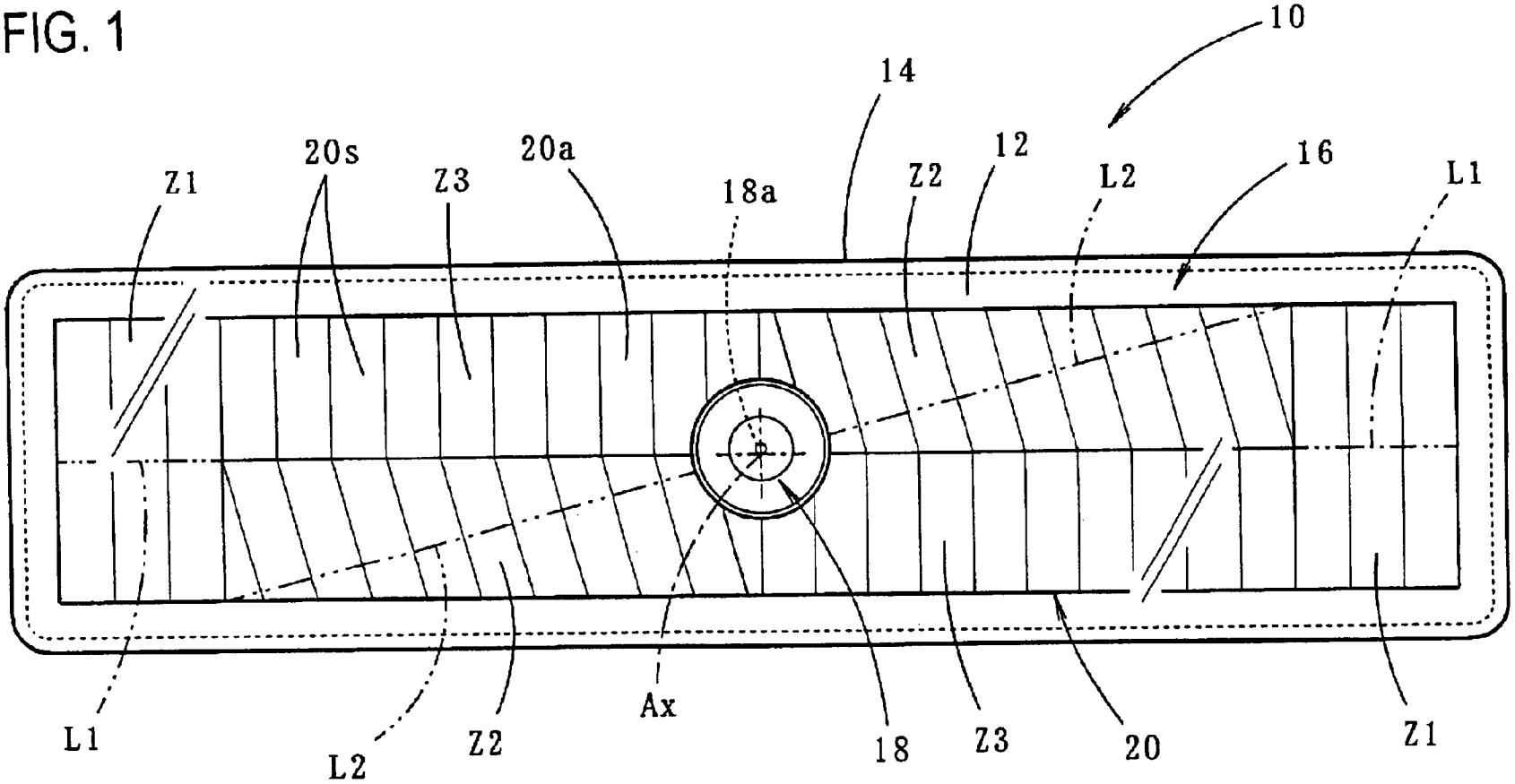
FIG. 1 is a front view showing a vehicular headlamp constructed according to a preferred embodiment of the present invention.

FIG. 1 is a front view showing a vehicular headlamp 10 constructed according to a first preferred embodiment of the present invention.

As shown in the FIG. 1, the vehicular headlamp 10 has a substantially horizontally elongated rectangular shape in outline when viewed from the front. A reflector unit 16 is provided which is tiltable in vertical and lateral (horizontal) directions by an aiming mechanism (not shown) positioned in a lamp chamber defined by a translucent cover 12 and a lamp body 14.

Figure 2:
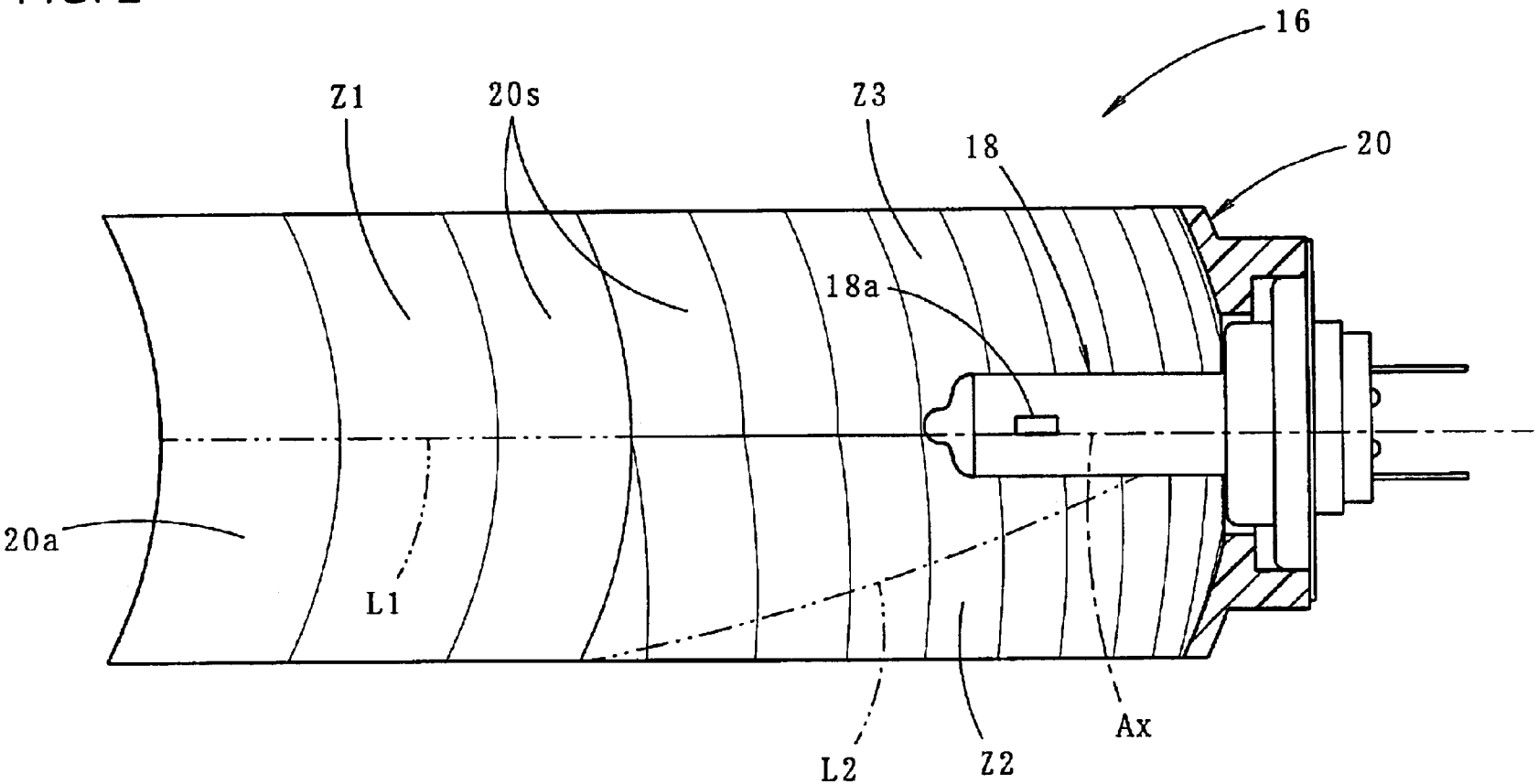
FIG. 2 is a vertical sectional view showing a reflector unit of the vehicular headlamp of FIG. 1.

FIG. 2 is a vertical sectional view showing the reflector unit 16.

As shown also in FIG. 2, the reflector unit 16 includes a light source bulb 18 and reflector 20, and has a lamp optical axis Ax extending in the longitudinal direction of the vehicle. The reflector unit 16 is configured such that the lamp optical axis Ax is directed slightly downward (by an angle of approximately 0.5 to 0.6 degrees) with respect to the longitudinal direction of the vehicle in accordance with the specified aiming adjustment.

A light source bulb 18, which is a halogen bulb (H7 type) having a single filament as a light source 18*a*, is attached to a rear apex portion of the reflector 20 such that the light source 18*a* is positioned substantially coaxially with the lamp optical axis Ax and extends in the longitudinal direction of a vehicle. More particularly, the light source bulb 18 is attached to the reflector 20 such that the lower end of the light source 18*a* is made to coincide with the lamp optical axis Ax by slightly moving the central axis of the bulb parallel to a position above the lamp optical axis Ax.

The reflector 20 has a horizontally elongated rectangular shape whose height is small (for example, approximately 40 mm) in a front view of the lamp. The reflector 20 has a reflecting surface 20*a* formed by a plurality of reflecting elements 20*s* formed in the shape of a paraboloid of revolution whose central axis is the lamp optical axis Ax. The reflecting surface 20*a* diffuses, deflects and reflects light from the light source 18*a* forward with the reflecting elements 20*s* which form the reflecting surface 20*a*.

Figure 3:
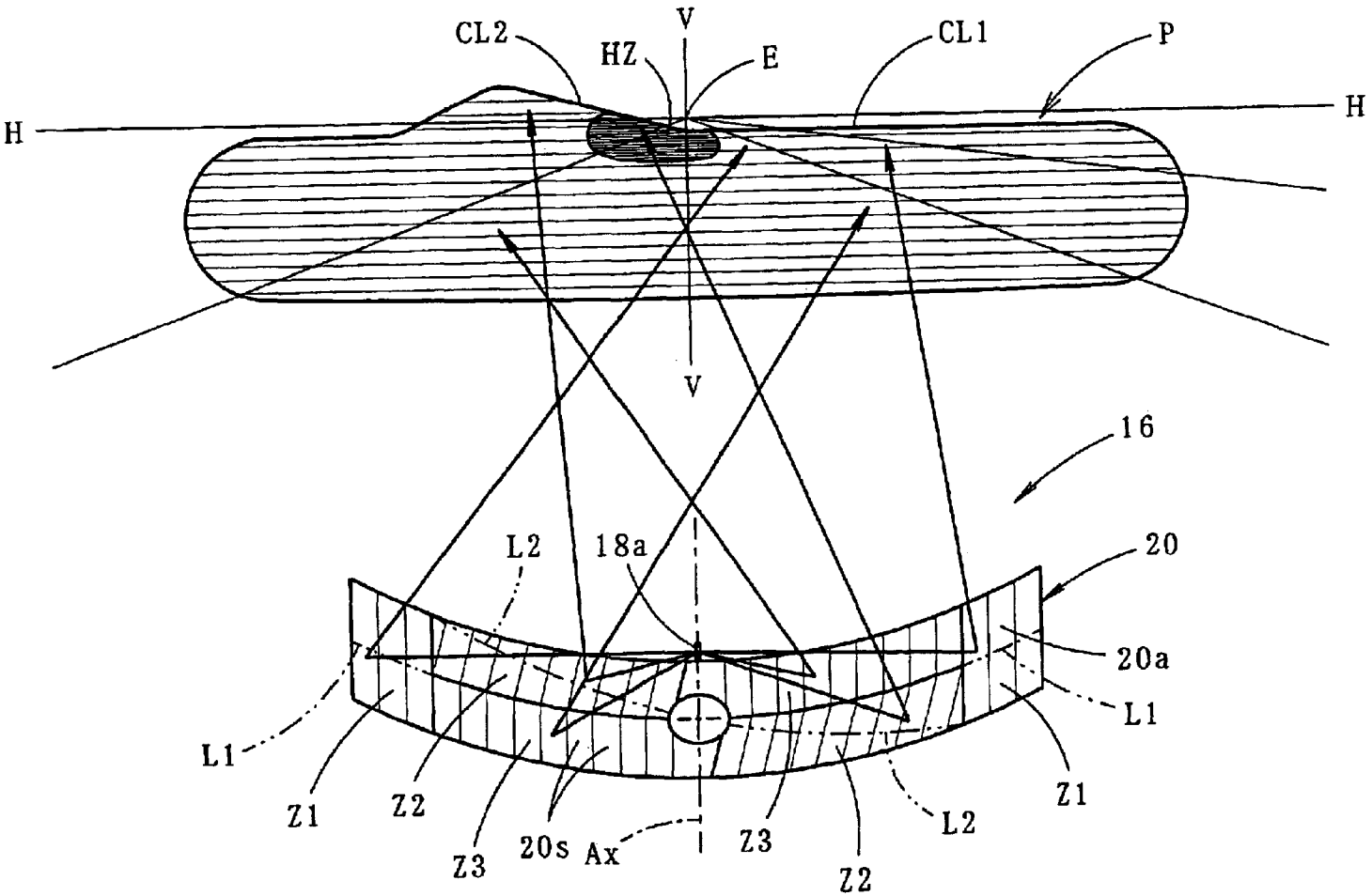
FIG. 3 is a perspective view showing a low-beam light distribution pattern formed on a vertical screen arranged at a position 25 m forward of the vehicular headlamp, as well as the reflector unit as seen from a rear side thereof.

FIG. 3 is a perspective view showing a low-beam light distribution pattern P (L) formed on a vertical screen arranged at a position 25 m forward of the lamp by the vehicular headlamp 10 according to the above-described embodiment, along with the reflector unit 16 when seen from the rear side of the reflector unit 16.

The low-beam light distribution pattern P (L) has a horizontal cut-off line CL1 on the opposite lane side, and has an oblique cut-off line CL2 which extends upward from the cut-off line CL1 to the traveling lane side at an angle of about 15 degrees. An elbow point E is positioned slightly below (by approximately 0.5 to 0.6 degrees) the horizontal axis H directly ahead of the lamp. A hot zone HZ is formed in the low-beam light distribution pattern P (L) so as to surround the elbow point E and extending primarily on its left side. In this embodiment, the horizontal cut-off line and the oblique cut-off line CL1, CL2 are formed by appropriately designing the shape of the reflecting surface 20*a* without using a shade or the like, as will be explained below in detail.

Figure 4:
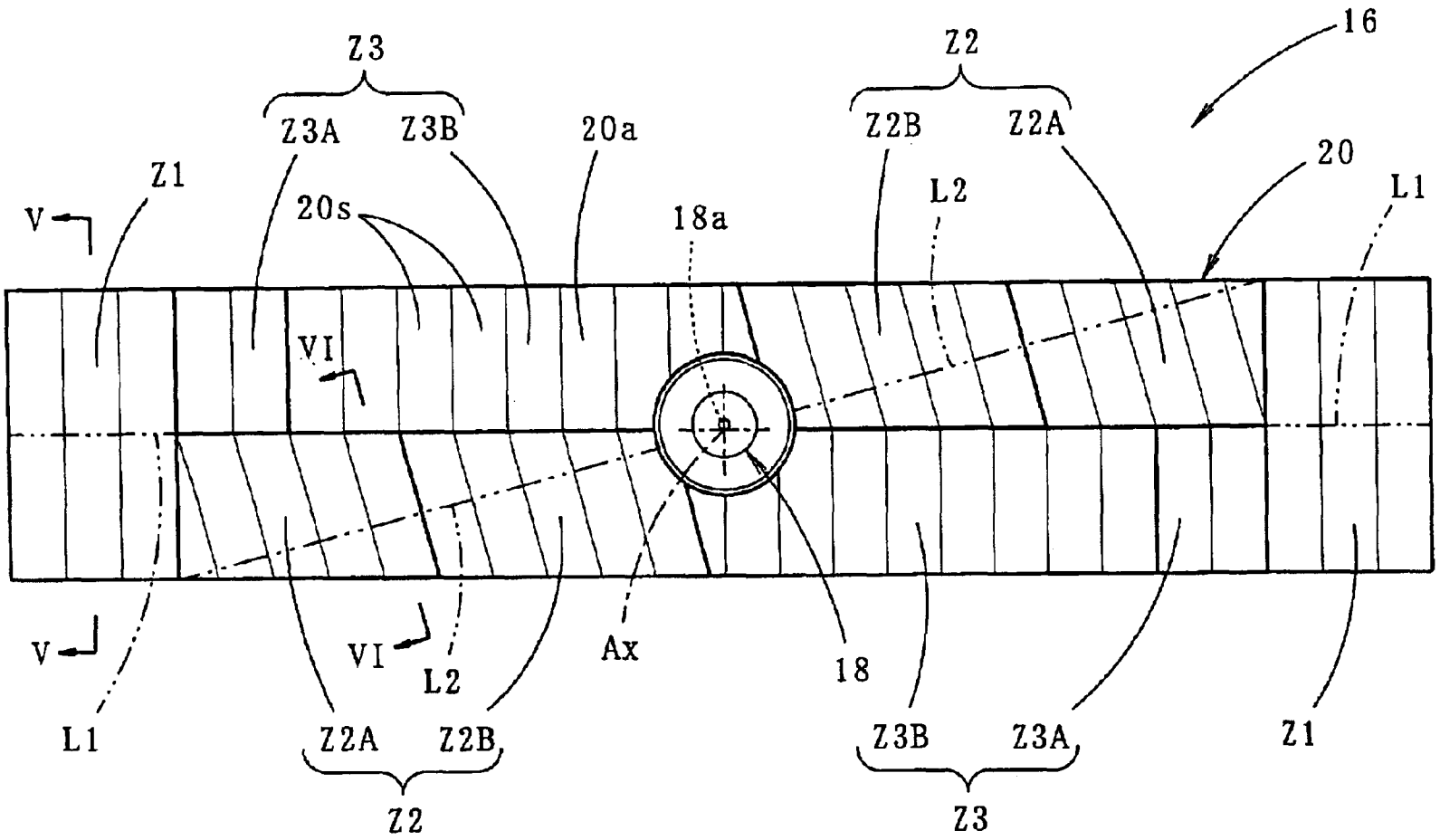
FIG. 4 is a front view showing the reflector unit.

FIG. 4 is a front view showing the reflector unit 16.

As shown in the diagram, the reflecting surface 20*a* includes first reflecting zones Z1 which reflect light so as to form the horizontal cut-off line CL1, second reflecting zones Z2 which reflect light so as to form the oblique cut-off line CL2, and third reflecting zones Z3 which reflect light so as to form the other portions of the low-beam light distribution pattern P (L).

The first reflecting zones Z1 are provided at two positions on right and left end portions of the reflecting surface 20*a*, and the second reflecting zones Z2 are provided at two positions (lower-left and upper-right in a front view of the lamp) on right and left sides of the lamp optical axis Ax, which are diagonally positioned with respect to the lamp optical axis Ax. Portions other than the first and the second reflecting zones Z1, Z2 form the third reflecting zones. As is explained in more detail below, the boundary between the second reflecting zones Z2 and the first reflecting zones Z1 on a peripheral side of the second reflecting zones is along an oblique line L2 extending in a lower-left direction at an angle of 15 degrees and in an upper-right direction at an angle of 15 degrees from the lamp optical axis Ax, intersecting the lower end edge of the reflecting surface 20*a*, or is set in the vicinity of the right and left sides of the intersection.

Each of the reflecting elements 20*s* of the first reflecting zones Z1 is formed in a vertically elongated rectangular shape, arranged vertically astride the horizontal line L1 (line of intersection of the horizontal surface including the optical axis Ax and the reflecting surface 20*a*) on the reflecting surface 20*a* which corresponds to the horizontal cut-off line CL1. The vertical sectional shape parallel to the optical axis Ax of each of the reflecting elements 20*s* of the first reflecting zones Z1 is in a form as shown in FIG. 5A, which is a cross-sectional view taken along line V—V in FIG. 4.

Namely, the vertical cross-sectional shape of each of the reflecting elements 20*s* of the first reflecting zones Z1 above the horizontal line L1 is in the form of a parabola Pr1 whose focus F1 is at a rear end position of the light source 18*a* on the lamp optical axis Ax and whose apex is at a predetermined point O (an apex of the paraboloid of revolution which is a reference surface of the reflecting surface 20*a*) to the rear of the focus F1 in an area above the horizontal line L1. The vertical sectional shape of each of the reflecting elements 20*s* of the first reflecting zones Z1 below the optical axis Ax is in the form of a parabola Pr2 whose focus F2 is at a front end position of the light source 18*a* on the lamp optical axis and whose apex is the predetermined point O in an area below the horizontal line L1.

Figure 5B:
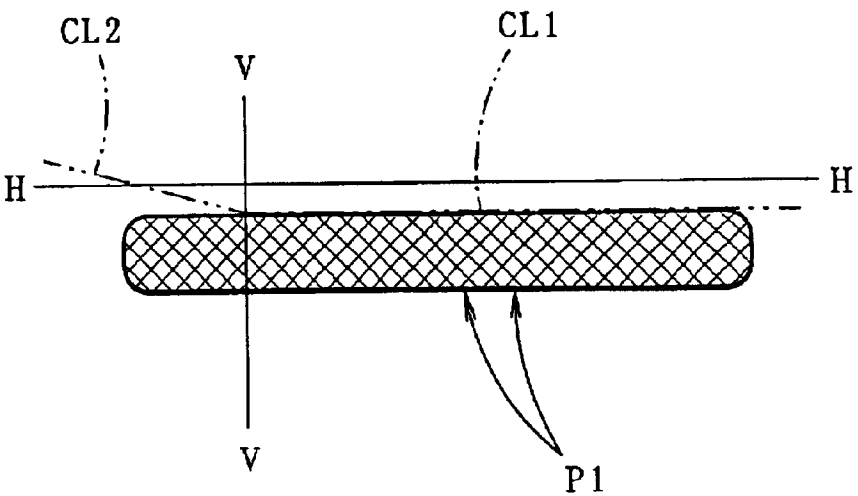
FIG. 5B shows the light distribution pattern produced by the first reflecting zones.
Figure 5A:
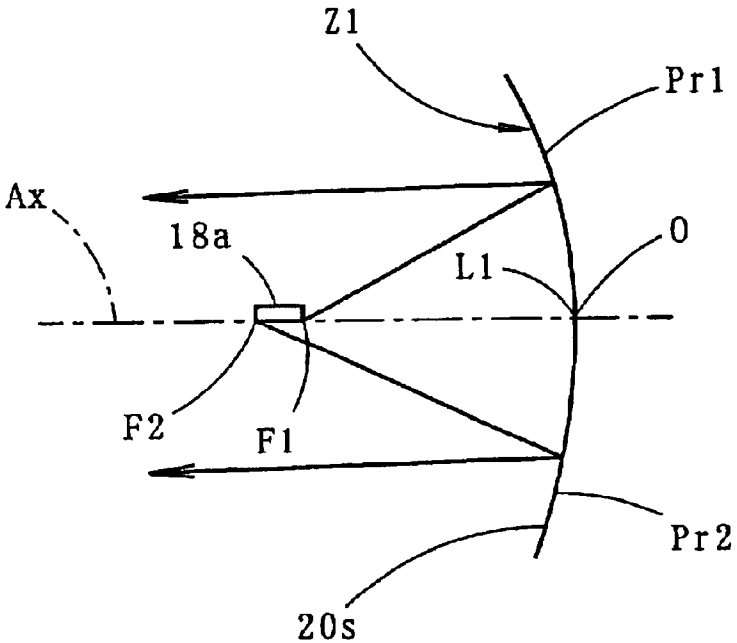
FIG. 5A is a vertical sectional view showing first reflecting zones of the reflector unit.

Thus, as shown in FIG. 5B, the light distribution pattern P1 produced by the light reflected from the reflecting elements 20*s* is formed such that the light reflected from each of the areas above and below the horizontal line L1 is superimposed, and the upper end edge forms part of the horizontal cut-off line CL1.

Each of the reflecting element 20*s* of the second reflecting zones Z2 has the configuration of a vertically elongated parallelogram tilted at an angle of 15 degrees with respect to the vertical direction. These reflecting elements are arranged vertically astride the oblique line L2 (intersection line of the surface which is rotated by 15 degrees with respect to the horizontal surface and the reflecting surface 20*a*) on the reflecting surface 20*a*, which corresponds to the oblique cut-off line CL2. The vertical sectional form of each of the reflecting elements 20*s* of the second reflecting zones Z2, which are tilted at an angle of 15 degrees and extend parallel to the optical axis Ax, has the shape shown in FIG. 6A, which is a cross-sectional view taken along line VI—VI in FIG. 4.

That is, the cross-sectional shape of each of the reflecting elements 20*s* of the second zone Z2 above the oblique line, which are tilted at an angle of 15 degrees, has the form of a parabola Pr1 whose focus F1 is at the rear end position of the light source 18*a* on the lamp optical axis Ax and whose apex is at the predetermined point O at the rear of the focus F1 in an area above the oblique line L2. The vertical cross-sectional shape of each of the reflecting elements 20*s* is that of a parabola Pr2 whose focus F2 is at the front end position of the light source 18*a* on the lamp optical axis and whose apex is at the predetermined point O in an area below the oblique line L2.

Figure 6B:
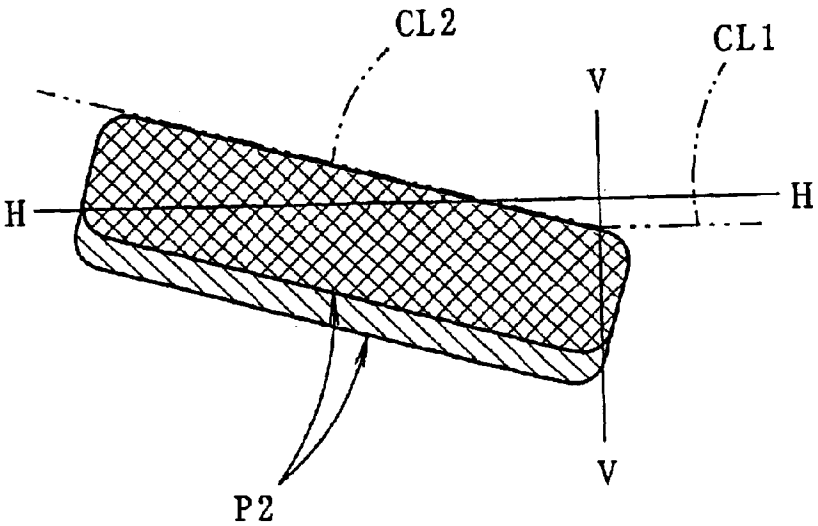
FIG. 6B shows the light distribution pattern produced by the second reflecting zones.
Figure 6A:
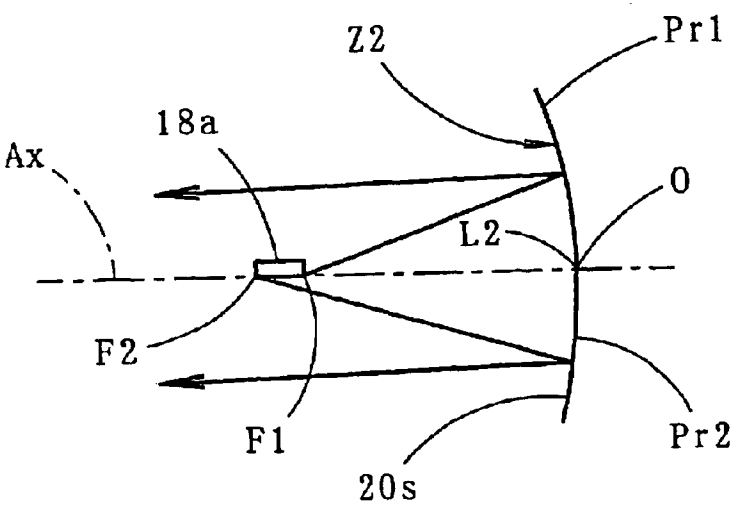
FIG. 6A is a vertical sectional view showing second reflecting zones of the reflector unit.

Thus, as shown in FIG. 6B, the light distribution pattern P2 produced by the light reflected from the reflecting elements 20*s* is formed in such a manner that the light reflected from each of the areas above and below the oblique line L2 is superimposed and the upper end edge forms part of the oblique cut-off line CL2.

Figure 7:
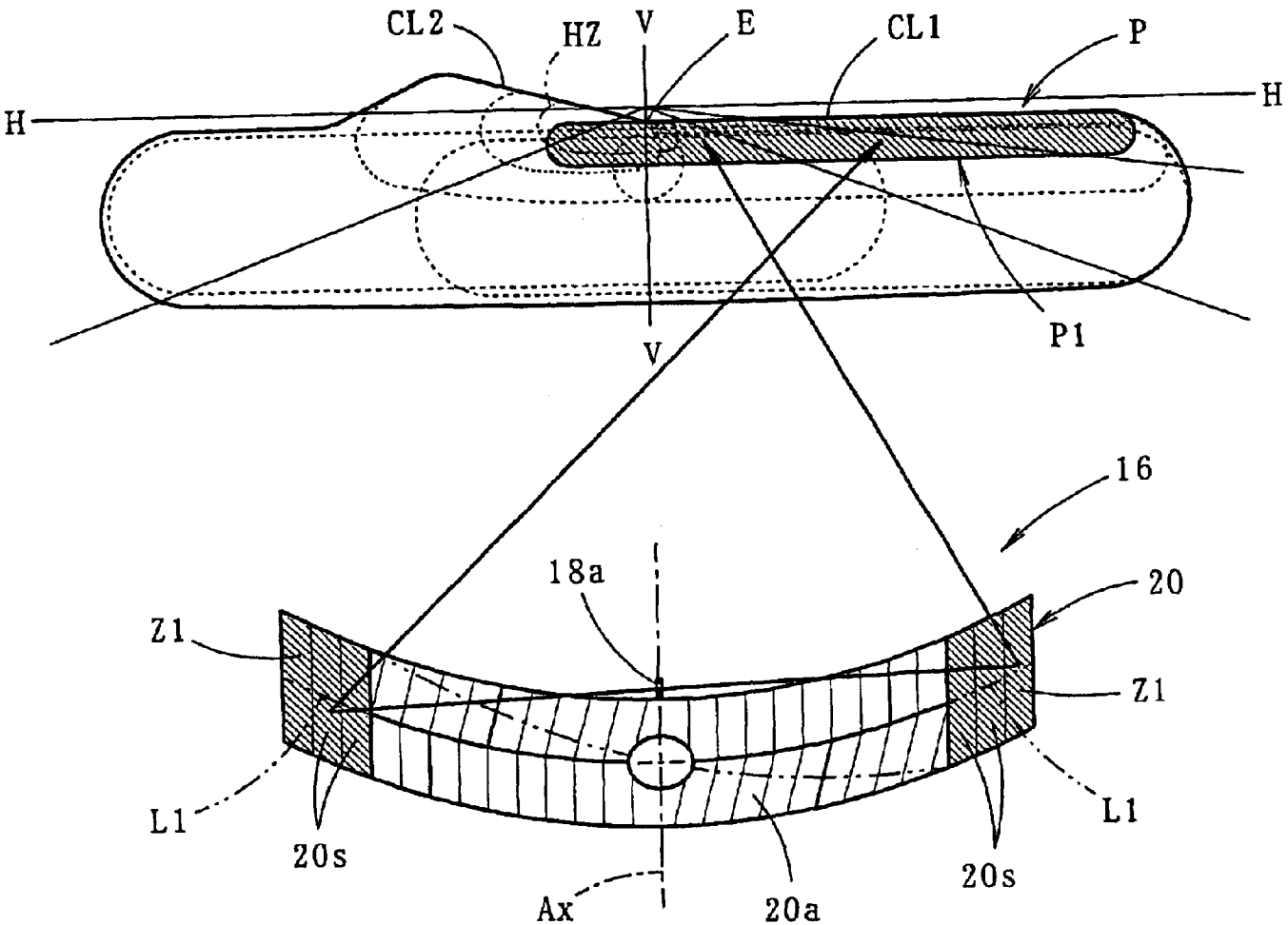
FIG. 7 is a perspective view showing a light distribution pattern formed on a vertical screen by the light reflected from the first reflecting zones of the reflecting surface.
Figure 8:
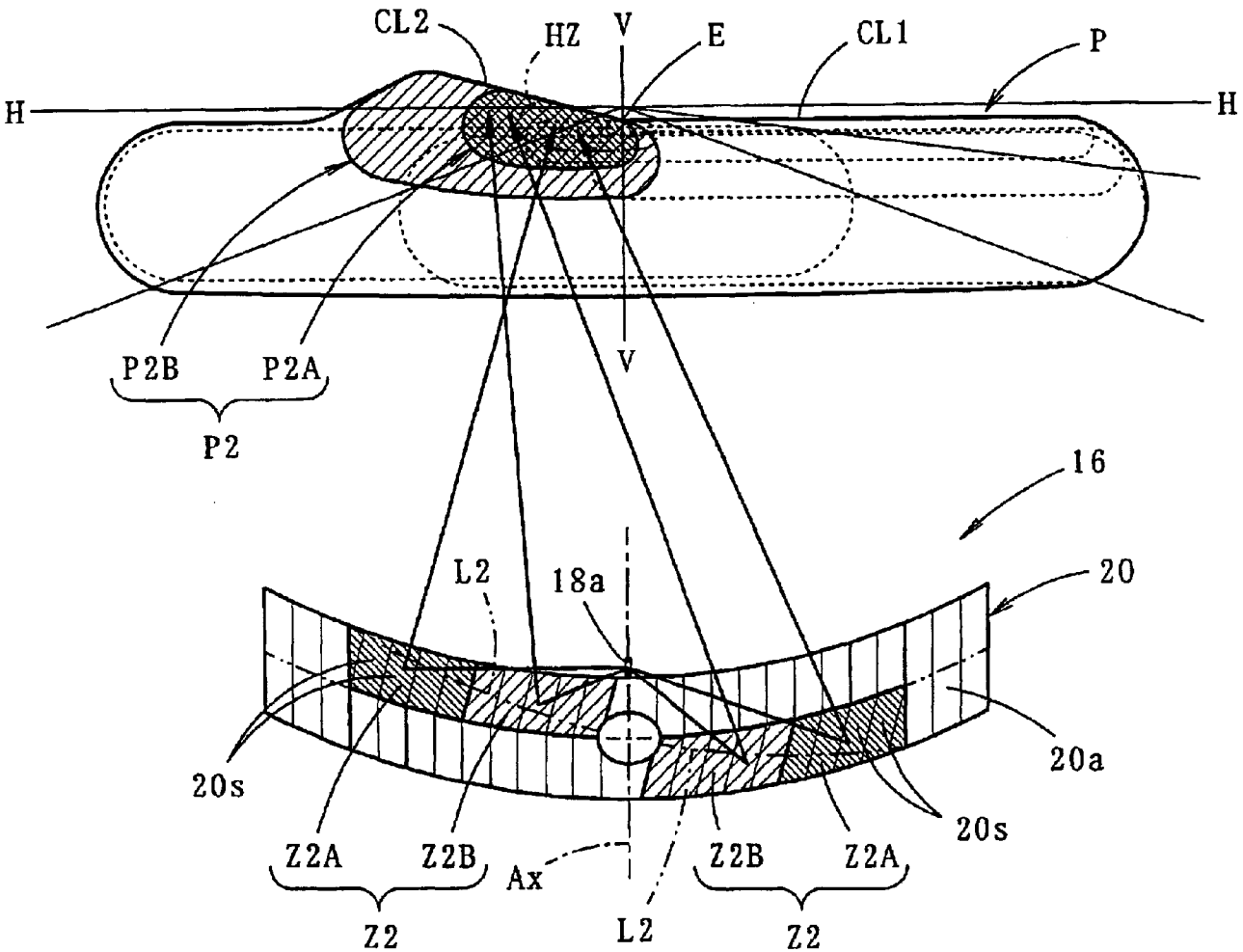
FIG. 8 is a perspective view showing a light distribution pattern formed on a vertical screen by the light reflected from the second reflecting zones of the reflecting surface.
Figure 9:
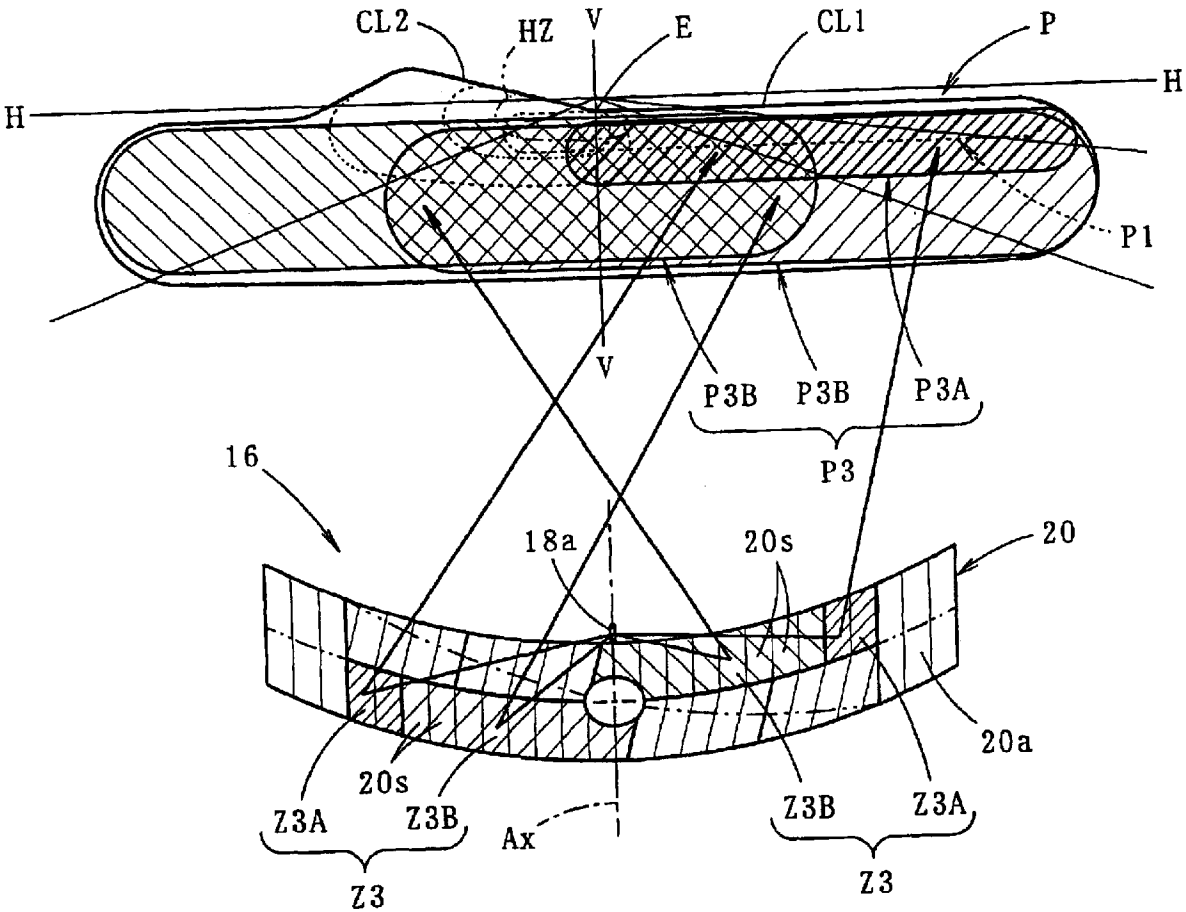
FIG. 9 is a perspective view showing a light distribution pattern formed on a vertical screen by the light reflected from the third reflecting zones of the reflecting surface.
Figure 10:
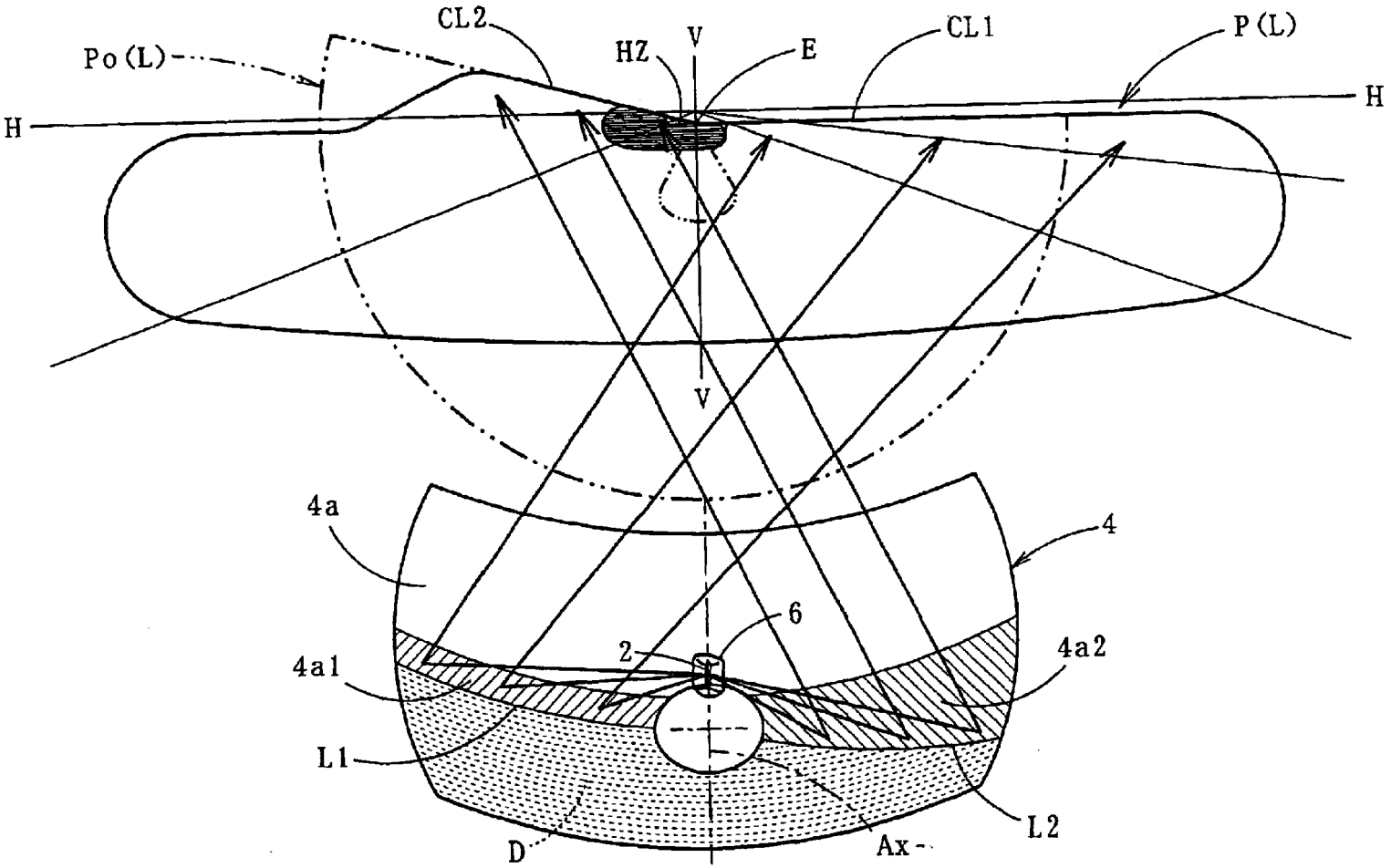
FIG. 10 is a diagram similar to FIG. 3 showing a conventional headlamp.
Figure 11:
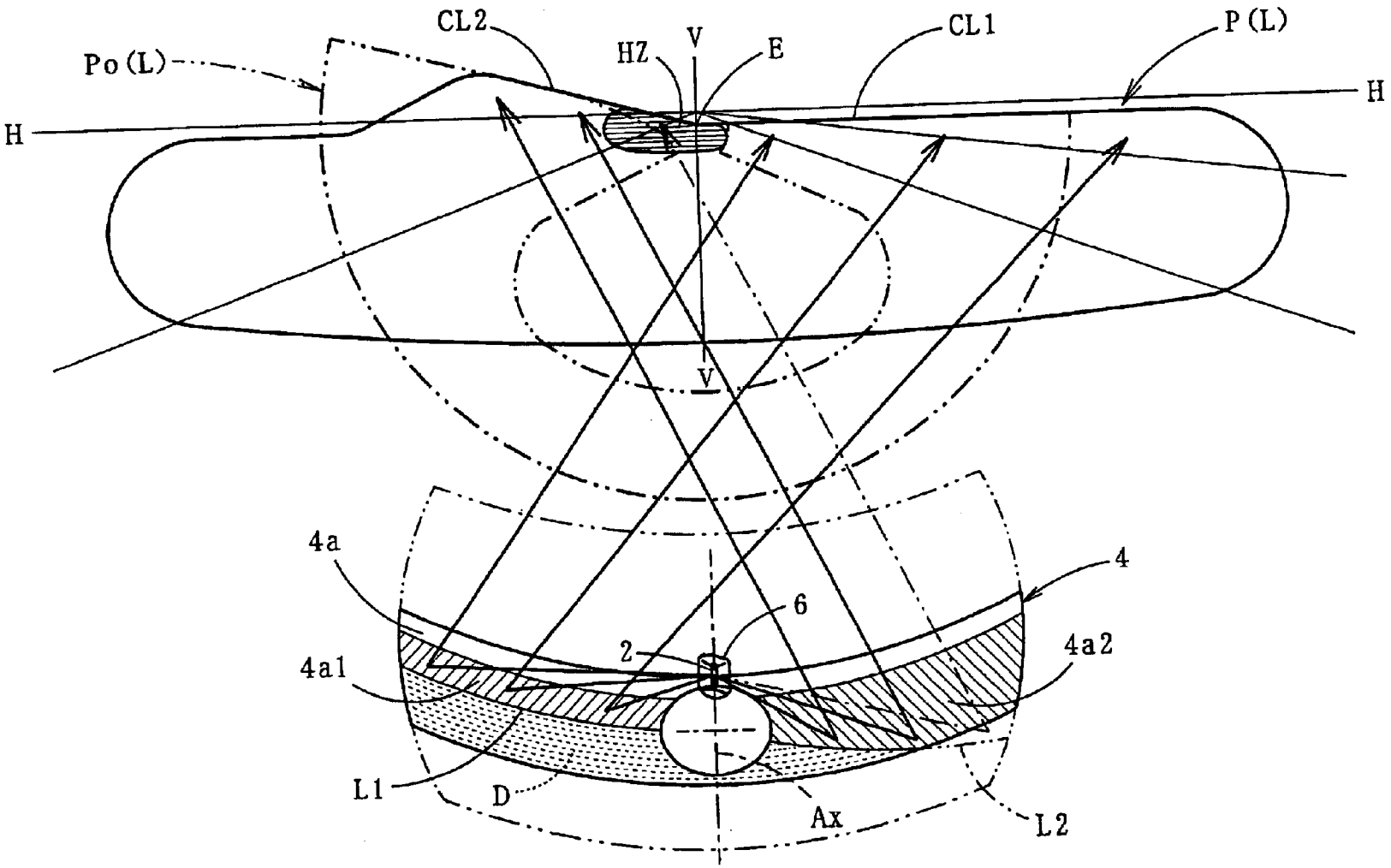
FIG. 11 is a diagram similar to FIG. 3 showing another example of a conventional headlamp.

FIGS. 7 to 9 are perspective views showing the light distribution patterns P1 to P3 formed by the light reflected by the first to third reflecting zones Z1 to Z3.

As shown in FIG. 7, the light distribution pattern P1 produced by the light reflected from a right and left pair of the first reflecting zones Z1 is formed such that the upper end edge thereof forms the horizontal cut-off line CL1 and the left end portion forms part of the hot zone HZ. Since the first reflecting zones Z1 are positioned at the right and left end portions of the reflecting surface 20*a*, the image of the light source 18*a* which is formed by the light reflected by each reflecting element 20*s* is quite small, which makes the allowable height of the light distribution pattern P1 considerably small.

As shown in FIG. 8, the light distribution pattern P2 produced by the light reflected from a right and left pair of the second reflecting zones Z2 is formed such that the upper end edge thereof forms the oblique cut-off line CL2 and the right end portion thereof forms most of the hot zone HZ. The light distribution pattern P2 is formed as a synthetic pattern of the light distribution pattern P2A formed by the light reflected from zones Z2A that are close to the outside, and the light distribution pattern P2B is formed by the light reflected from zones Z2B that are close to the inside in both of the second reflecting zones Z2.

Since the image of the light source 18*a* which is formed by the light reflected from the reflecting elements 20*s* of the zones Z2A close to the outside is relatively small, the light distribution pattern P2A is formed as a relatively small light distribution pattern close to the hot zone HZ. Since the image of the light source 18*a* formed by the light reflected from the reflecting elements 20*s* of the zones Z2B close to the inside is relatively large, the light distribution pattern P2A is formed as a relatively large light distribution pattern which extends along the entire length of the oblique cut-off line CL2.

As shown in FIG. 9, a light distribution pattern P3 formed by the light reflected from a right and left pair of the third reflecting zones Z2 is formed as a wide diffusion light distribution pattern which extends widely in the lateral direction so as to form portions other than the light distribution patterns P1, P2 in the low-beam light distribution pattern P (L). The light distribution pattern P3 is formed as a synthetic pattern of the light distribution pattern P3A formed by the light reflected from zones Z3A that are close to the outside and the light distribution pattern P3B formed by the light reflected from zones Z3B that are close to the inside in both of the third reflecting zones Z3.

Since the image of the light source 18*a* which is formed by the light reflected from the reflecting elements 20*s* of the zones Z3A close to the outside is small, the light distribution pattern P3A is formed so as to be diffused in a horizontal direction directly below the horizontal cut-off line CL1, which reinforces the luminous intensity in an area toward the front of the light distribution pattern P1 whose height is small. Moreover, since the image of the light source 18*a* which is formed by the light reflected from the reflecting elements 20*s* of the zones Z3B close to the inside is relatively large, the light distribution pattern P3B is formed as a large light distribution pattern which extends throughout the low-beam light distribution pattern P (L).

As explained above in detail, the vehicular headlamp 10 according to the invention provides a low-beam light distribution pattern P (L) having the horizontal and the oblique cut-off lines CL1, CL2. The reflecting surface 20*a* of the reflector 20 includes the first reflecting zones Z1, which reflect light so as to form the horizontal cut-off line CL1, and the second reflecting zones Z2, which reflect light so as to form the oblique cut-off line CL2. The second reflecting zones Z2 are provided at two positions on right and left sides of the lamp optical axis Ax arranged diagonally with respect to the lamp optical axis Ax, and the first reflecting zones Z1 are provided at two positions on right and left sides closer to the periphery of the reflector than the second reflecting zones Z2.

With this construction, the following actions and effects are obtained.

Since the second reflecting zones Z2 are provided at two positions on right and left sides of the lamp optical axis Ax which are arranged diagonally with respect to the lamp optical axis Ax, the amount of light in the hot zone HZ is increased by superimposing the light distribution patterns P1 and the light distribution pattern P2 which are formed by the light reflected from these two second reflecting zones Z2.

Accordingly, even if the height of the reflector 20 is small and the oblique line L2 which is formed as a reverse image of the oblique cut-off line CL2 falls below the lower end edge of the reflecting surface 20*a*, a sufficient amount of light in the hot zone HZ can be assured.

Also, since the first reflecting zones Z1 are provided at two positions on right and left sides which are closer to the periphery of the reflector than the second reflecting zones Z2, even if the second reflecting zones Z2 are provided at two positions on right and left sides of the lamp optical axis Ax which are diagonally positioned with respect to the lamp optical axis Ax, the horizontal cut-off line CL1 can be formed properly.

Thus, according to the invention, in the vehicular headlamp 10 which provides a low-beam irradiation light distribution pattern P (L) having the horizontal and the oblique cut-off lines CL1, CL2, although the height of the reflector 20 is small, the distant visibility in the traveling lane is enhanced by assuring a sufficient amount of light in the hot zone HZ in the low-beam light distribution pattern P (L).

In the above-described embodiment where a halogen bulb of the H7 type is used as the light source bulb 18, the light from the light source 18*a* can strike the entire area of the reflecting surface 20*a*. Accordingly, the low-beam light distribution pattern can be formed at a higher luminous intensity level by efficiently using the entire reflecting surface 20*a*.

In a vehicular headlamp having a reflector whose height is large, instead of having a reflector 20 whose height is small such as the reflector used in the above-described embodiment, distant visibility in the traveling lane can be further enhanced by employing the same configuration as in the embodiment so as to increase the amount of light in the hot zone.

It should further be apparent to those skilled in the art that various changes in form and detail of the invention as shown and described above may be made. It is intended that such changes be included within the spirit and scope of the claims appended hereto.

What is claimed is:

1. A vehicular headlamp for forming a low-beam light distribution pattern having a horizontal cut-off line and an oblique cut-off line, comprising: a light source provided substantially coaxially with a lamp optical axis extending in a longitudinal direction of a vehicle on which said headlamp is mounted, and a reflector having a reflecting surface that reflects light from said light source in a forward direction, said reflecting surface comprising first reflecting zones which reflect light so as to form said horizontal cut-off line, and second reflecting zones which reflect light so as to form said oblique cut-off line, said second reflecting zones being provided at respective positions on right and left sides of said lamp optical axis and being arranged diagonally with respect to said lamp optical axis, and said first reflecting zones being provided at respective positions on right and left sides closer to a periphery of said headlamp than said second reflecting zones.

2. The vehicular headlamp according to claim 1, wherein said light source comprises a light bulb arranged so that light from said light source can strike all of said reflecting surface.

3. The vehicular headlamp according to claim 1, wherein said light source comprises a light bulb comprising light blocking means for blocking a portion of light from said light bulb.

4. The vehicular headlamp according to claim 1, wherein a boundary between said first and second reflecting zones is at a position at which an oblique line at an angle of approximately 15 degrees intersects a lower edge of said reflecting surface.

5. The vehicular headlamp according to claim 1, wherein each of said first reflecting zones comprises a plurality of reflecting elements formed in a vertically elongated rectangular shape and abutting on one side a horizontal line intersecting said lamp optical axis.

6. The vehicular headlamp according to claim 5, wherein each of said first reflecting elements above said horizontal line in vertical cross section has the shape of a parabola having a focus at a rear end position of said light source and an apex to the rear of said focus and above said horizontal line, and each of said first reflecting elements below said horizontal line in vertical cross section has the shape of a parabola having a focus at a front end position of said light source and an apex the same as said apex of said first reflecting elements above said horizontal axis.

7. The vehicular headlamp according to claim 1, wherein each of said second reflecting zones comprises a plurality of reflecting elements formed in a shape of a vertically elongated parallelogram.

8. The vehicular headlamp according to claim 1, wherein each of said second reflecting zones comprises a plurality of reflecting elements formed in a shape of a vertically elongated parallelogram having one side abutting an oblique line passing through said lamp optical axis.

9. The vehicular headlamp according to claim 8, wherein said oblique line is inclined at an angle of approximately 15 degrees with respect to a horizontal line.

10. The vehicular headlamp according to claim 1, wherein each of said second reflecting zones comprises a plurality of reflecting elements formed in a shape of a vertically elongated parallelogram having one side abutting an oblique line passing through said lamp optical axis, and wherein each of said second reflecting elements above said oblique line in vertical cross section has the shape of a parabola having a focus at a rear end position of said light source and an apex to the rear of said focus and above said horizontal line, and each of said first reflecting elements below said oblique line in vertical cross section has the shape of a parabola having a focus at a front end position of said light source and an apex the same as said apex of said second reflecting zones above said horizontal axis.

* * * * *